175-40 SR
3/17/81 OR 4,256,189

United States Patent [19]
Fox et al.
[11] 4,256,189
[45] Mar. 17, 1981

[54] WELL DRILLING TOOL

[75] Inventors: Fred K. Fox; Martin L. Tomek, both of Houston, Tex.

[73] Assignee: Engineering Enterprises, Inc., Houston, Tex.

[21] Appl. No.: 40,328

[22] Filed: May 18, 1979

[51] Int. Cl.[3] ..... E21B 4/02
[52] U.S. Cl. ..... 175/40; 175/107; 175/228
[58] Field of Search ..... 175/39, 40, 107, 227–229

[56] References Cited

U.S. PATENT DOCUMENTS

| | | | |
|---|---|---|---|
| 3,807,513 | 4/1974 | Kern | 175/107 |
| 3,971,450 | 7/1976 | Fox | 175/107 |
| 4,019,592 | 4/1977 | Fox | 175/107 X |
| 4,080,115 | 3/1978 | Sims et al. | 175/107 |
| 4,114,702 | 9/1978 | Maurer et al. | 175/228 |

*Primary Examiner*—William F. Pate, III
*Attorney, Agent, or Firm*—Marvin B. Eickenroht; Jennings B. Thompson

[57] ABSTRACT

A well drilling tool is disclosed as having an inner tubular member rotatably supported from an outer tubular member by means of bearings contained within an annular lubricant chamber between them. An annular chamber is formed in an inner tubular member to provide a reservoir for supplying additional lubricant to the chamber to replace that which is lost during use of the tool. An annular piston is sealably slidable within the reservoir, and drilling fluid, which is circulated through a passageway through the tool, is admitted to one end of the reservoir by a port in the inner member to urge the piston toward the other end of the reservoir which connects with the lubricant chamber.

9 Claims, 4 Drawing Figures 16
14
11
10
B
21
15
18
17
22A
22
19
27
23
53
50
33
28
12
26
20
24
39
13

12
15
11
22B
22A
22
19

WELL DRILLING TOOL

This invention relates generally to well drilling tools having tubular members which are supported for relative rotation by means of bearings contained within a lubricant chamber in an annular space between the members. More particularly, it relates to improvements in tools of this type having a reservoir for supplying additional lubricant to the lubricant chamber in the event of loss of same during use of the tool.

In use, the tool is connected as part of a drilling string, and drilling fluid is circulated downwardly through a passageway formed by the tubular members and upwardly within the annulus between the tool and well bore. Thus, one such member may comprise a housing or case suspended from the lower end of the string, the other may comprise a hollow shaft rotatably supported by the case and suspending a bit on its lower end. A motor, such as a turbine, may be disposed within the annular space between the case and shaft for rotating the shaft and thus the bit without the necessity for transmitting torque from the surface to the case through thousands of feet of drilling string. The passageway thus includes the annular space in which the turbine is disposed and which is connected by ports through the shaft to the bore of the shaft leading to the bit at its lower end.

U.S. Pat. No. 3,971,450 shows tools of this type in which first and second means are provided for sealing between the inner and outer members within the annular space respectively above and below bearings contained within the lubricant chamber, and a third means is provided for sealing between such members within said space above the first sealing means or below the second sealing means, and thus either above or below the bearings. When the third sealing means is above the bearings, a port is formed in the outer member to connect the annular space between the first and third sealing means with the outside of the tool, and when the third sealing means is below the bearings, a port is formed in the inner member to connect the annular space between the second and third sealing means with the inside of the tool. Thus, in either case, the pressure differential between the inside and outside of the tool acts across the third sealing means, and the first and second sealing means serve primarily to separate drilling fluid from the lubricant, and thus protect the thrust bearings in the chamber from abrasive particles in the drilling fluid. In the various embodiments of the tool shown in the patent, one or both of the first and second sealing means is vertically slidable in the annular space, or some other means is provided to compensate for pressure changes outside of the lubricant chamber.

Although the outside pressure acting across each of the first and second sealing means is essentially the same, they are nevertheless susceptible to failure due to abrasive materials in the drilling fluid, especially since they are disposed between shaft and case or other relatively rotating tubular members of the tool. If lubricant leaks from the chamber, and is replaced by the heavier drilling fluid, the bearings are quickly worn and the tool must be retrieved to permit their replacement and/or repair. In an effort to lengthen the usable life of the bearings, it was also proposed in U.S. Pat. No. 3,971,450 to provide a tool of the first-described type—i.e., in which the bearings are below the lubricant chamber—with a reservoir for supplying additional lubricant, as needed, to the chamber. As shown in such patent, the reservoir is formed in the lower end of the inner member, and thus beneath the bearings and the lowermost second sealing means, and is connected by a tube to the lubricant chamber. More particularly, a piston slidable within the reservoir has one side responsive to pressure of the drilling fluid on the outside of the tool to force lubricant from the reservoir and into the lubricant chamber automatically in response to the loss of a predetermined volume of the lubricant. The piston serves not only to constantly urge the lubricant pressure from the reservoir, but also to compensate for pressure changes acting over the outer side of the first and second sealing means.

It is the primary object of the present invention to provide a reservoir for replacing lubricant which is lost from the lubricant chamber of a tool of this type wherein the bearings are above the lubricant chamber.

These and other objects are accomplished, in accordance with the illustrated embodiment of the present invention, by a tool of this type in which an annular reservoir formed in the inner member and concentrically of the lubricant reservoir connects at one end with the port connecting with the passageway through the inner member and at the other end with the lubricant reservoir. More particularly, a piston is sealably slidable within the reservoir, in response to pressure of the drilling fluid which enters the reservoir to force lubricant therefrom and into the lubricant chamber to replace that which is lost from such chamber.

The bearings include thrust bearings, and the means for sealing between the members includes first and second sealing means respectively above and below the thrust bearings. More particularly, the means for sealing between the members include third sealing means sealing below the second sealing means to form the lubricant chamber between the first and third sealing means. The second sealing means permits lubricant to flow therepast only in an upward direction, and the reservoir connects with the lubricant chamber intermediate the second and third sealing means. Preferably, the reservoir is located vertically intermediate the second and third sealing means, and the end of the reservoir connecting with the passageway is above the other end which connects with the lubricant chamber. Preferably, one or more radial bearings are disposed between the inner and outer members in the portion of the annular space intermediate the second and third sealing means.

In the illustrated embodiment of the invention wherein a means is provided for indicating to an operator at the surface that a predetermined volume of lubricant has been lost, a hole is formed in the inner member to connect the reservoir with the annular space to permit drilling fluid to by-pass the piston and flow into the chamber upon indication that such volume has been lost. In this way, if lubricant is lost because of leakage past the lower, pressure dividing third sealing means, drilling fluid is able to flow through the annular space and out of the tool without imposing undue pressure differentials across the first and second sealing means above and below the thrust bearings.

As also shown in a copending application, executed by Fred K. Fox on Apr. 24, 1979, entitled "WELL DRILLING TOOL", and assigned to the assignee of the present application, the means for so indicating the loss of lubricant may comprise a sleeve which is released from supported position in the passageway through the inner member, as the piston moves past the by-pass hole in the inner member, and a means for receiving the sleeve, when so released, in a position to restrict flow through the passageway. As also described in such application, this restriction indicates the loss of lubricant to an operator at the surface by increasing the resistance to the flow of drilling fluid.

Preferably, the port includes a tube which extends upwardly and inwardly from the reservoir into the passageway through the inner member, and the upper, open end of the tube is substantially perpendicular to the longitudinal axis of the passageway, whereby drilling fluid has complete freedom to flow into the tube. Also, the second sealing means permits lubricant to flow therepast only in an upward direction and thus into the portion of the lubricant chamber in which the thrust bearings are contained. More particularly, a conduit is formed in the outer member to bypass the second sealing means, and a check valve is disposed in the conduit to permit flow only in a downward direction in response to a predetermined pressure differential across the second sealing means.

In the drawings, wherein like reference characters are used throughout to designate like parts:

Figure 1:
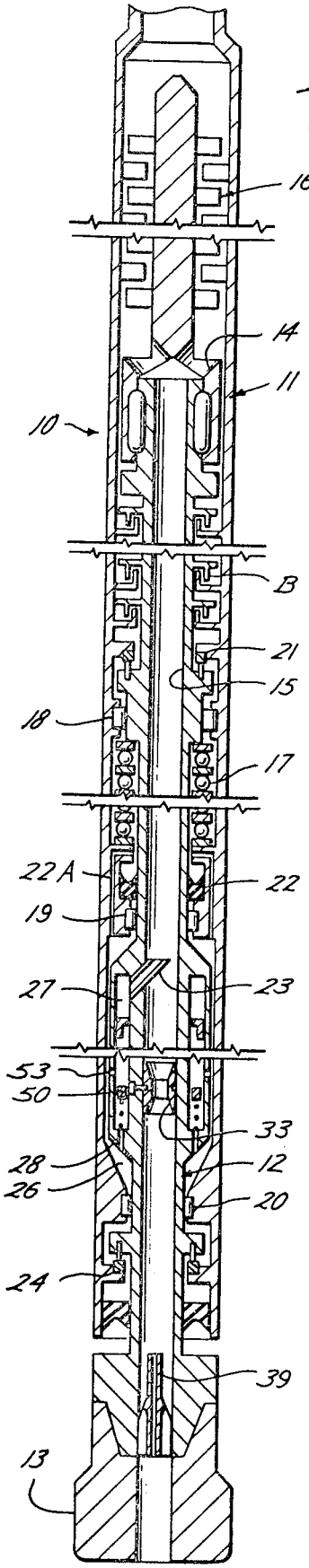
FIG. 1 is a vertical sectional view of a tool constructed in accordance with the present invention, such tool being discontinued at different levels along its length for purposes of clarity.
Figure 2:
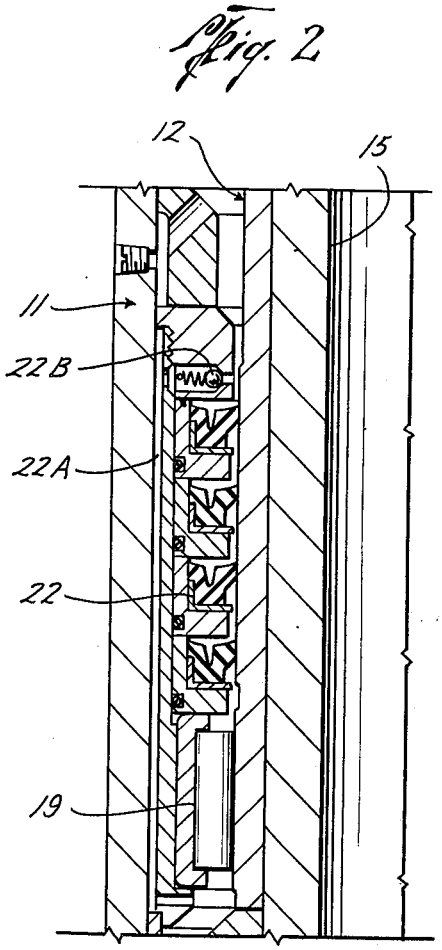
FIG. 2 is an enlarged vertical sectional view of one side of a portion of the tool of FIG. 1, including the second sealing means and the conduit which by-passes it.

With reference now to the details of the above-described drawings, the overall tool, which is indicated in its entirety by reference character 10, is shown in FIG. 1 to comprise a housing or case 11 having its upper end adapted to be connected to the lower end of the drill string (not shown), and a shaft 12 mounted for rotation within the case 11 and supporting a bit 13 at its lower end. Thus, the case and shaft constitute relatively rotatable tubular members which make up a body extending from connection of the upper end of the case with the drill string to connection of the lower end of the shaft with the bit.

As well known in the art, the tool is lowered on the drill string into a well bore, and drilling fluid of relatively heavy specific gravity is circulated downwardly through the drill string and the tool, out the lower end of bit 13, and upwardly within the annulus between the tool and the well bore. As shown in FIG. 1, ports 14 connect an annular space between the upper end of the shaft and the case with a bore 15 through the shaft connecting at its lower end with a bore through bit 13. Thus, the case and shaft form a passageway through the body of the tool 10 connecting the well string with the bore.

In the illustrated tool, shaft 12 is rotated with respect to case 11, so as to impart rotation to bit 13, by means of a turbine 16 comprising stators on the inner diameter of the case, and cooperating rotors on the outer diameter on the upper end of shaft 12 above ports 14 in the shaft. Hence, the tool comprises what is known as a turbodrill wherein the shaft and thus the bit 13 are caused to rotate in response to the circulation of drilling fluid downwardly through the turbine 16.

The portion of the shaft 12 below ports 14 is spaced from the case 11 to provide an annular space in which bearings are received for supporting the shaft from the case. As shown in FIG. 1, these bearings include thrust bearings 17 in the form of balls mounted as an assembly between a downwardly facing shoulder on the shaft and an upwardly facing shoulder on the case, as well as radial bearings 18, 19 and 20 in the form of rollers carried by the case for rotation about vertical axes. As shown in FIG. 1, the bearings are contained within a lubricant chamber 26 within the space formed between upper and lower seals 21 and 24 sealing between the case and shaft, the thrust bearings 17 and upper radial bearings being separated from the remainder of the lubricant chamber beneath them by an intermediate seal 22.

Both seals 21 and 24 are so-called "face" types of well known construction, but reversed end for end with respect to one another so that upper seal 21 is arranged to prevent flow therepast in an upward direction and lower seal 24 is arranged to prevent flow therepast in a downward direction. The intermediate seal 22 comprises a stack of cup-type sealing rings of resilient material having upwardly diverging lips on their inner and outer diameters which permit flow therepast in an upward direction, but prevent it in a downward direction. Thus, as will be understood from the description to follow, although lubricant may be forced past seal 22 to fill the portion of the chamber above it, or to replace lubricant which is lost therefrom, it may not, under ordinary circumstances, flow from such portion into the remainder of the chamber therebelow.

An annular space is formed within the shaft to provide a reservoir 27 from which lubricant may be supplied to the lubricant chamber. The lower end of the reservoir is connected to the lubricant chamber by one or more ports 28, and a tube 23 provides a port through the shaft to connect its bore with the upper end of the reservoir. Thus, drilling fluid above seal 21 and below seal 22 is ordinarily at substantially the same pressure—i.e., the pressure of drilling mud within the passageway—and the differential pressure between drilling fluid on the inside and outside of the tool is taken across the lower seal 24, so that a leak from the lubricant chamber will ordinarily first occur at its lower end—i.e., past seal 24.

However, since the lubricant is normally of a specific gravity considerably less than that of the relatively heavy drilling fluid, there may be considerable pressure acting downwardly across seal 21 due to motion transmitted to the drilling fluid by vibration of the tool. It is therefore preferred to protect seal 21 from the drilling fluid by means of a column of grease which, as described in my earlier U.S. Pat. No. 4,019,591, may have particles of metal of a high specific gravity dispersed therein to raise the specific gravity of the column of heavy grease above that of the drilling fluid. As illustrated diagrammatically in FIG. 1, the column of heavy grease may be contained in a series of vertically stacked buckets B which impede passage of the metal particles which might settle out from the grease into the lower end of the column and thus onto seal 21.

Each of the face seals 21 and 24 may be of suitable conventional, commercially available construction, such as that shown and described in my prior U.S. Pat. No. 3,971,540. Thus, as illustrated in FIG. 4, each includes sleeves mounted on each of the shaft and case, and having flat annular surfaces on their ends which are caused to slide over one another during rotation of the shaft with respect to the case.

Figure 3:
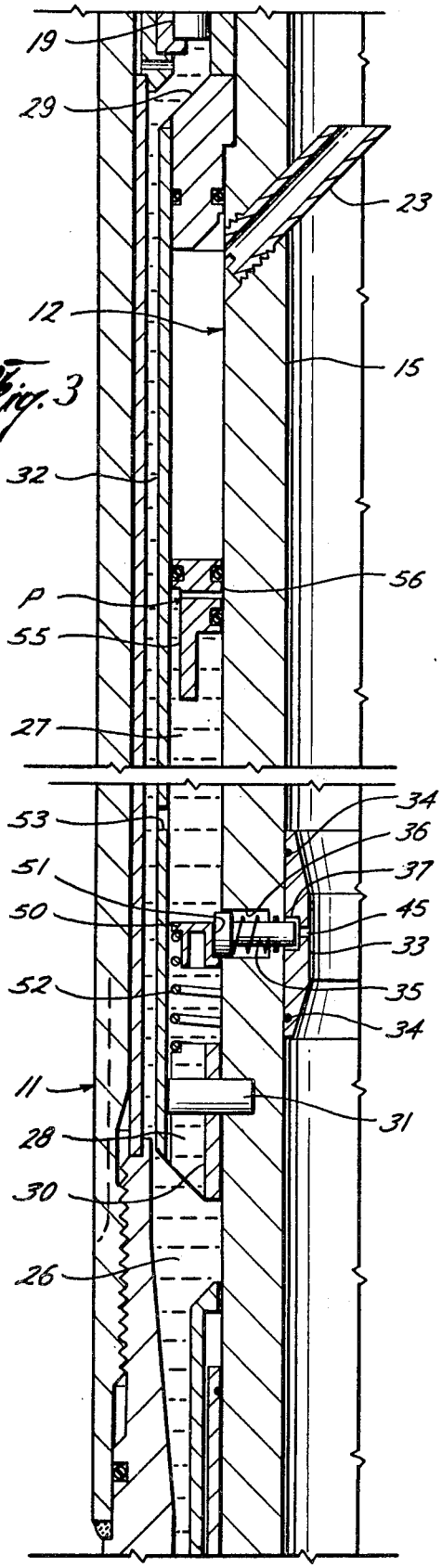
FIG. 3 is an enlarged vertical sectional view of one side of another portion of the tool of FIG. 1, including the reservoir and the means for indicating the loss of a predetermined volume of lubricant.
Figure 4:
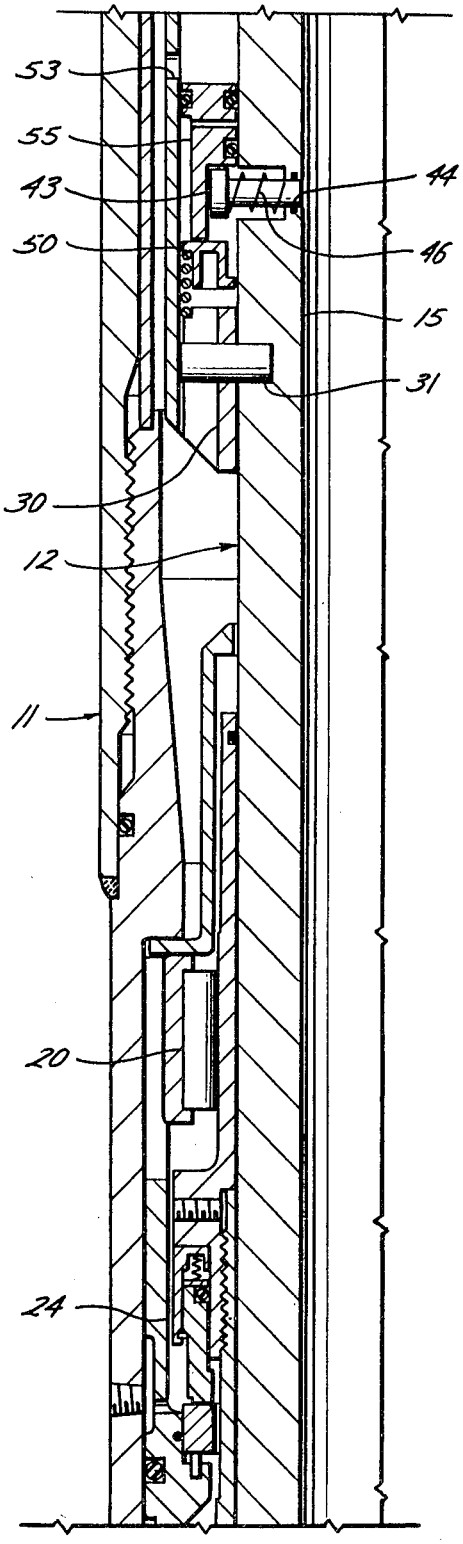
FIG. 4 is an enlarged vertical sectional view of one side of still another portion of the tool, including the lower end of the reservoir and means for indicating lubricant loss, but differing from FIG. 2 in that the piston slidable within the reservoir has moved to a position for releasing the sleeve.

As best shown in FIGS. 3 and 4, the shaft 12 includes a sleeve 32 mounted about an inner portion thereof to form the inner and outer walls of the annular space in which reservoir 27 is formed. The upper end of the space is closed by means of a ring 29 welded or otherwise secured to the sleeve 32 and having seal rings about its inner and outer diameters for sealing with respect to the shaft and sleeve, respectively. The lower end of sleeve 32 is disposed about another ring 30 which is mounted on the shaft by means of a pin 31, and ports 28 are formed through ring 30 to connect the lower end of reservoir 27 with the lubricant chamber.

An annular piston P having seal rings on its inner and outer diameters is sealably slidable within reservoir 27 to separate the upper level of lubricant therein from drilling fluid admitted to the reservoir from bore 15 of the shaft through tube 23. The drilling fluid constantly urges the piston in a downward direction so that if lubricant leaks past seal 24 and out of the lubricant chamber, additional lubricant is supplied thereto from the reservoir. As shown, tube 23 extends upwardly and inwardly from the inner diameter of the reservoir to the axis of bore 15 of the shaft, and its upper end is cut on a bias to extend perpendicularly to the axis of the bore, and thus provide a large opening to receive downwardly flowing drilling fluid. Thus, the tube acts as a pitot tube to insure that pressure in the reservoir is sufficiently high to continually urge piston P in a downward direction.

As lubricant is supplied from the reservoir to the lubricant chamber, piston P gradually moves downwardly. Although FIGS. 1 and 3 are discontinuous intermediate the length of the reservoir, it will be understood that it may be of considerable length. However, when piston P approaches the lower end of the reservoir, a means is provided for indicating to the operator at the surface that this level has been reached, and thus that continued use of the tool runs the risk of damaging the bearings, so that the operator may discontinue the circulation of drilling fluid and pull the tool from the well bore.

As previously mentioned, and as described in detail in the aforementioned copending patent application, this indicating means comprises a sleeve 33 received within the bore 15 of the shaft with its outer diameter fitting closely within the bore and sealed with respect thereto by means of seal rings 34. The sleeve 33 is held in an upper position (FIG. 3) within the bore by means of one or more retainer pins 35 extending through holes in the shaft connecting its bore with the reservoir portion 27. Inasmuch as the sleeve is relatively thin, it provides a minimum of obstruction to flow through the bore 15 of the shaft when supported in the upper position of FIG. 3.

The pin is shiftable between an inner position in which its inner end fits within an annular groove 37 about the sleeve to hold the sleeve in the position of FIG. 3, and an outer position in which the pin is withdrawn from the groove, as shown in FIG. 4, to release the sleeve for movement downwardly to a position within an annular opening of a bridge 39 threadedly connected within a lower portion of the bore. When the sleeve is so received, it diverts all flow through a central opening in the bridge which is of considerably lesser cross-sectional area than that through the sleeve so as to restrict and thus cause a noticeable increase in the pressure of the drilling fluid which may be observed by the operator.

As shown in FIGS. 3 and 4, each retainer pin 35 has a head 43 on its outer end which fits within the enlarged outer portion of opening 36, and the stem of the pin extends through the reduced inner end portion of opening 36. A seal ring 44 is mounted within the opening to form a sliding seal about the stem as the retainer pin moves between its inner and outer positions of FIGS. 3 and 4. A hole 45 is formed in the sleeve to connect with its annular recess 37 and thus prevents a pressure lock which might otherwise interfere with the free movement of the sleeve downwardly within the bore 15 when released. Each of the retainer pins 35 is urged to its outer position, in which the inner end of its stem is withdrawn from the bore 15 of the shaft, by means of a coil-spring 46 surrounding the stem and acting between the head 43 on the stem and a shoulder connecting the enlarged and reduced diameter portions of the opening 36.

Each of the retainer pins may be held in its inner position by means of a ring 50 disposed within reservoir 27 and having an inner circumference 51 adapted to engage the outer ends of heads 43 to oppose the forces of springs 46. Thus, in order for the retainer pins to be moved to their outer positions under the influence of spring 46, holding ring 50 must be moved downwardly in the reservoir to a position in which the inner diameter 51 thereof is removed from engagement with the outer ends of retainer pin heads 43. As shown, ring 50 is held in holding position by means of a coil-spring 52 compressed between the upper end of ring 30 and an annular flange about the outer diameter of ring 50. More particularly, the force of this coil-spring holds an annular flange about the inner diameter of the holding ring upwardly against the lower edges of the heads 43 of the retainer pins so as to limit upward movement of the holding ring 50 beyond the position of FIG. 3.

The holding ring is adapted to be moved downwardly out of holding position by a lower extension 55 of piston P as the piston moves downwardly to the position of FIG. 4 upon the loss of a predetermined volume of lubricant from the reservoir. Thus, as shown, the inner diameter of the extension moves downwardly past the heads of the retainer pins and is of such length as to insure movement of the inner diameter 51 of the holding ring to a position past the heads before the inner portion of the piston lands upon such heads, as shown in FIG. 4. Preferably, downward movement of the piston is limited by compression of spring 52 before the piston lands on the heads of the retainer pins.

As shown in FIGS. 3 and 4, a port 53 formed in sleeve 32 is uncovered by piston P as the piston moves to the position of FIG. 3 to release sleeve 33. Thus, until the circulation of the drilling fluid is discontinued, high pressure drilling fluid bypasses the reservoir to flow into the lubricant chamber 26, from which it will ordinarily flow out of the tool past lower seal 24, which, as previously noted, is the most susceptible to wear. This then prevents the pressure differential between the drilling fluid inside and outside of the tool from acting over upper seal 21, so that, with seal 22 disposed beneath thrust bearings 17 they, together with upper bearing 18, are in any event protected from the drilling fluid. That is, only bearings 19 and 20 may be damaged by any drilling fluid which enters the annular chamber 26.

One or more conduits 22A are formed in the case to connect with the lubricant chamber 26 above and below seal 22, and a check valve 22B in each such conduit prevents flow therethrough in an upward direction, but permits flow therethrough in a downward direction to bypass seal 22, when the pressure in the portion of the chamber above seal 22 exceeds that below it by a predetermined amount. This arrangement is useful in maintaining lubricant in the portion of the chamber above seal 22, and thus protecting thrust bearings 17, even though it may be lost from a lower portion of the chamber before shaft rotation can be stopped. On the other hand, check valve 22B is a safety feature in that it prevents lubricant in the upper end of the chamber from being overpressurized due to heat from the thrust bearings.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A well drilling tool, comprising an elongated body connectible as part of a drill string having a drill bit at its lower end, said body having relatively rotatable, inner and outer tubular members forming a passageway through which drilling fluid may be circulated and an annular space between the members, bearings within the annular space to support one member from the other, means sealing between the members within said space above and below the bearings to form a lubricant chamber in which said bearings are contained, an annular reservoir formed within the inner member concentrically of the lubricant chamber, one end of the reservoir connecting with the passageway through the inner member, and the other end thereof connecting within the chamber, and a piston sealably slidable within the reservoir, in response to pressure of the drilling fluid which enters the reservoir, to force lubricant out of the reservoir and into the chamber in order to replace lubricant which is lost therefrom.

2. A well drilling tool of the character defined in claim 1, wherein said bearings include thrust bearings, said means sealing between said members includes first and second sealing means respectively above and below the thrust bearings, and third sealing means below the second sealing means to form the lubricant chamber between the first and third sealing means, said second sealing means permits lubricant to flow therepast only in an upward direction, and said reservoir connects with the chamber intermediate the second and third sealing means.

3. A well drilling tool of the character defined in claim 2, wherein the reservoir is located vertically intermediate the second and third sealing means, and the one end thereof is above the other end thereof.

4. A well drilling tool of the character defined in claim 1, wherein means are provided for indicating to an operator at the surface that a predetermined volume of lubricant has been lost, and a hole in the inner member connects the reservoir with the annular space to permit drilling fluid to by-pass the piston and flow into the chamber upon indication that such volume of lubricant has been lost.

5. A well drilling tool of the character defined in claim 1, wherein the port includes a tube extending upwardly and inwardly from the reservoir into the passageway, and the upper open end of the tube is substantially perpendicular to the passageway.

6. A well drilling tool of the character defined in claim 2, including radial bearings in the portion of the chamber intermediate the second and third sealing means.

7. A well drilling tool of the character defined in claim 2, whrein a conduit is formed in the outer member to by-pass the second sealing means, and a check valve is disposed in the conduit to permit lubricant to flow out of the portion of the chamber in which the thrust bearings are contained in response to a predetermined pressure differential across the second sealing means.

8. A well drilling tool of the character defined in claim 1, wherein the upper end of the outer member is connectible to a portion of the drill string thereabove, and the lower end of the inner member is connectible to a portion of the drill string therebelow.

9. A well drilling tool of the character defined in claim 8, wherein turbine blades are mounted on the inner and outer member within the annular space between them so that the inner member is rotated with respect to the outer member in response to the flow of drilling fluid therethrough, and holes are formed in the inner member to permit drilling fluid to pass between the space and the passageway through the inner member.

* * * * *